US008851171B2

(12) United States Patent
Rudic

(10) Patent No.: US 8,851,171 B2
(45) Date of Patent: Oct. 7, 2014

(54) SCREEN ASSEMBLY

(75) Inventor: Aleksandar Rudic, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 309 days.

(21) Appl. No.: 13/270,346

(22) Filed: Oct. 11, 2011

(65) Prior Publication Data

US 2012/0090839 A1 Apr. 19, 2012

Related U.S. Application Data

(60) Provisional application No. 61/394,489, filed on Oct. 19, 2010.

(51) Int. Cl.
*E21B 43/08* (2006.01)
*E21B 43/04* (2006.01)
*E21B 43/10* (2006.01)

(52) U.S. Cl.
CPC ..... *E21B 43/082* (2013.01); *E21B 43/108* (2013.01)
USPC ..... 166/278; 166/51; 166/207; 166/236

(58) Field of Classification Search
USPC ..... 166/278, 51, 207, 236, 228
See application file for complete search history.

(56) References Cited

U.S. PATENT DOCUMENTS 2,796,939 A * 6/1957 Woodruff ..... 166/228
4,917,183 A * 4/1990 Gaidry et al. ..... 166/278
5,004,049 A 4/1991 Arterbury
5,050,678 A * 9/1991 Gaidry et al. ..... 166/278
5,115,864 A * 5/1992 Gaidry et al. ..... 166/278
5,150,753 A * 9/1992 Gaidry et al. ..... 166/278
5,901,789 A 5/1999 Donnelly et al.
6,571,871 B2 6/2003 Lauritzen et al.
6,766,862 B2 * 7/2004 Chatterji et al. ..... 166/381
6,868,905 B2 3/2005 Lauritzen et al.
6,877,553 B2 * 4/2005 Cameron ..... 166/207
6,932,159 B2 * 8/2005 Hovem ..... 166/296
6,932,161 B2 * 8/2005 Cameron ..... 166/384
7,048,048 B2 5/2006 Nguyen et al.
7,048,063 B2 * 5/2006 Cameron ..... 166/381
7,073,601 B2 * 7/2006 Cameron ..... 166/381
7,673,678 B2 3/2010 MacDougall et al.
7,743,835 B2 6/2010 Willauer
7,832,490 B2 11/2010 Willauer
7,926,565 B2 4/2011 Duan et al.
2003/0056947 A1 3/2003 Cameron
2003/0056948 A1 * 3/2003 Cameron ..... 166/206

(Continued)

OTHER PUBLICATIONS

"Baker Hughes Announces Revolutionary Conformable Sand Control System", GeoFORM Press Release, Mar. 10, 2011; pp. 1-2.

(Continued)

*Primary Examiner* — Jennifer H Gay
(74) *Attorney, Agent, or Firm* — Patrick A. Traister; Brandon S. Clark

(57) ABSTRACT

An apparatus that is usable with a well includes a string and a screen assembly, which is adapted to be run downhole on the string. The screen assembly includes a tubular carrier and a container. The container includes a gravel pack layer that includes gravel. The tubular carrier and the gravel pack layer are adapted to be radially expanded downhole; and the tubular carrier, container and the gravel pack layer are adapted to be run downhole as a unit.

18 Claims, 4 Drawing Sheets

(56) References Cited

U.S. PATENT DOCUMENTS

| | | | | |
|---|---|---|---|---|
| 2003/0131997 | A1* | 7/2003 | Chatterji et al. | 166/278 |
| 2004/0040723 | A1* | 3/2004 | Hovem | 166/384 |
| 2004/0251033 | A1* | 12/2004 | Cameron et al. | 166/382 |
| 2005/0139359 | A1 | 6/2005 | Maurer et al. | |
| 2005/0173109 | A1* | 8/2005 | Cameron | 166/206 |
| 2005/0279515 | A1* | 12/2005 | Cameron | 166/384 |
| 2009/0255686 | A1* | 10/2009 | Richard et al. | 166/376 |
| 2010/0089565 | A1* | 4/2010 | Duan et al. | 166/51 |
| 2012/0090839 | A1* | 4/2012 | Rudic | 166/278 |

OTHER PUBLICATIONS

International Search Report and Written Opinion of PCT Application No. PCT/US2011/056092 dated Apr. 10, 2012.

* cited by examiner

SCREEN ASSEMBLY

This application claims the benefit under 35 U.S.C. §119 (e) to U.S. Provisional Patent Application Ser. No. 61/394,489, entitled, "IN-SITU GRAVEL PACK," which was filed on Oct. 19, 2010, and is hereby incorporated by reference in its entirety.

BACKGROUND

Fluid producing and injection wells may be located in subterranean formations that contain unconsolidated particulates, which may migrate out of the formation with the oil, gas, water, or other fluid produced from the well. If appropriate measures are not undertaken, production of such particulates, often labeled "sand," may abrade the production and surface equipment, such as tubing, pumps and valves; and the particulates may partially or fully clog the well and reduce the fluid production.

For purposes of controlling the sand production in a given zone, or stage, of the well, a tubing string that communicates produced fluid may contain a screen that is positioned in the stage. The screen may contain filtering media through which the produced fluid flows into the tubing string and which prevents the sand from entering the tubing string. Moreover, a gravel packing operation may be performed to deposit a substrate called "gravel" around the periphery of the screen for purposes of filtering out the sand from the produced fluid and stabilizing the wellbore. In a gravel packing operation, a gravel-laden slurry is communicated downhole into the annulus surrounding the screen so that the fluid from the slurry returns into the tubing string, leaving deposited gravel around the screen.

SUMMARY

In an embodiment, a screen assembly that contains a tubular carrier and a gravel pack layer (containing gravel) is run downhole into a stage of a well; and the screen assembly is radially expanded in the stage. The expansion of the screen assembly includes expanding the tubular carrier and the gravel pack layer.

DETAILED DESCRIPTION

In the following description, numerous details are set forth to provide an understanding of features of various embodiments. However, it will be understood by those skilled in the art that the subject matter that is set forth in the claims may be practiced without these details and that numerous variations or modifications from the described embodiments are possible.

As used herein, terms, such as "up" and "down"; "upper" and "lower"; "upwardly" and downwardly"; "upstream" and "downstream"; "above" and "below"; and other like terms indicating relative positions above or below a given point or element are used in this description to more clearly describe some embodiments. However, when applied to equipment and methods for use in environments that are deviated or horizontal, such terms may refer to a left to right, right to left, or other relationship as appropriate.

In general, systems and techniques are disclosed herein for purposes of completing a particular zone, or stage, of an open hole wellbore using an expandable screen assembly, which contains a gravel pack layer that is run downhole with the screen assembly. More specifically, as described below, the expandable screen assembly includes a tubular carrier that contains openings to communicate well fluid, and the gravel pack layer surrounds the tubular carrier. The screen assembly is run downhole and positioned in a particular stage to be completed.

Once in position, the tubular carrier is expanded, which, in turn, causes the expansion of the outer gravel pack layer. Due to the tubular carrier and the gravel pack layer being run downhole as a unit, a relatively full gravel pack coverage is achieved for the stage while generally avoiding voids, sand bridges and annular gaps, which may otherwise be present due to the non-uniform shape of the wellbore.

Figure 1:
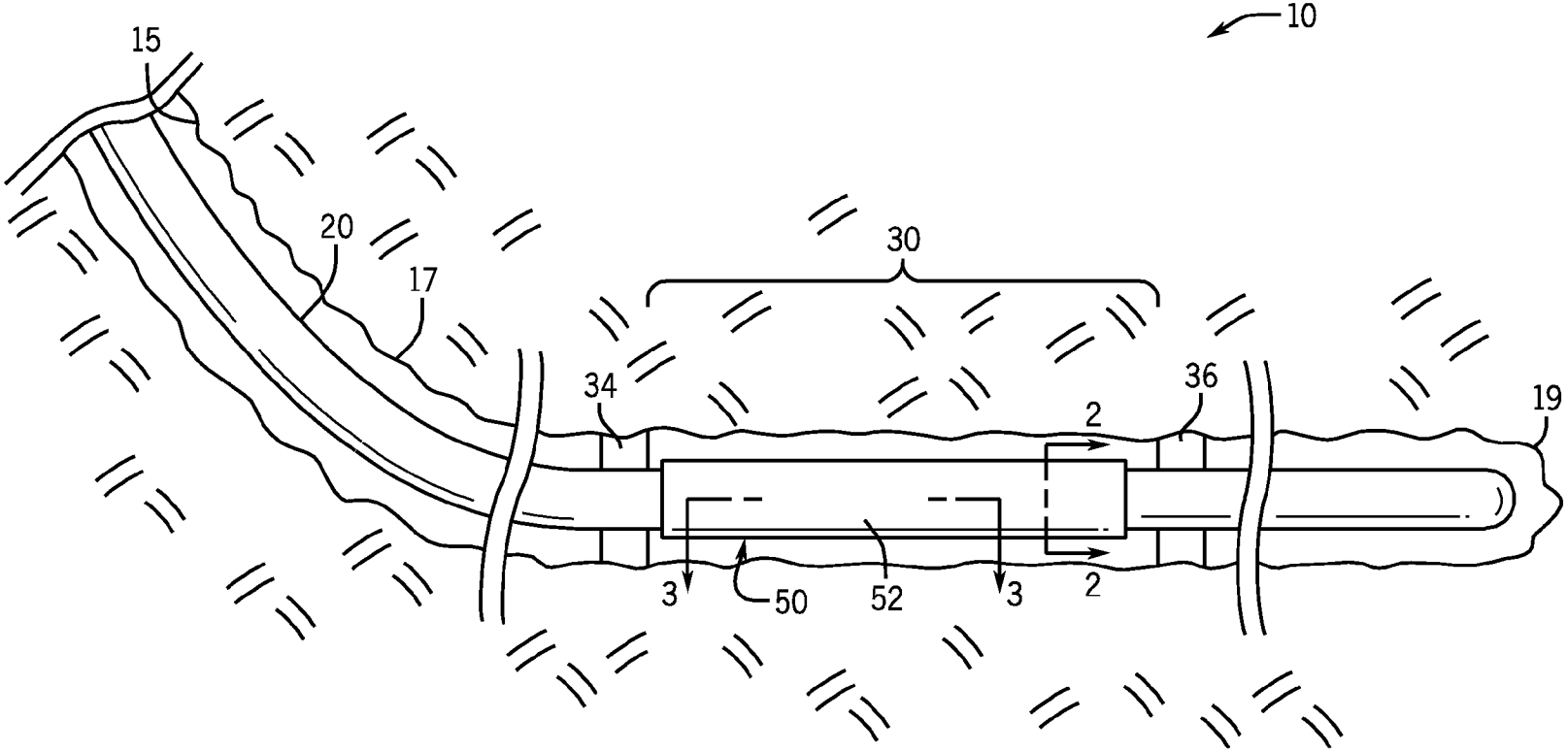
FIG. 1 is a schematic diagram of a well according to some embodiments.

Referring to FIG. 1, as a more specific non-limiting example, in accordance with some embodiments, a well 10 includes a wellbore 15, which traverses one or more hydrocarbon-bearing formations (as a non-limiting example). In general, the wellbore 15 extends from a heel end 17 to a toe end 19 through one or multiple zones, or stages, of the well 10, such as a stage 30 that is depicted in FIG. 1 as a non-limiting example. In general, as depicted in FIG. 1, once in position, the tubing string 20 may be secured to the surrounding formation by one or more packers, such as packers 34 and 36. For the example that is depicted in FIG. 1, the stage 30 extends between the packer 34 (forming the upper boundary for the stage 30) and the packer 36 (forming the lower boundary for the stage 30).

It is noted that although FIG. 1 and the subsequent figures depict a lateral wellbore 15, the techniques and systems that are disclosed herein may likewise be applied to vertical wellbores. Moreover, in accordance with some embodiments, the well 10 may contain multiple wellbores, which contain tubing strings that are similar to the tubing string 20 and which may contain similar screen assemblies 50. Additionally, the tubing string 20 may contain additional screen assemblies 50, which are positioned in other stages 30 (not shown) of the wellbore 15. Thus, many variations are contemplated and are within the scope of the appended claims.

The tubing string 20 for this example forms an injection or production string 20, which may be used to communicate fluids to or from the stages (such as stage 30) and the Earth surface of the well 10. In the state of the well 10, which is depicted in FIG. 1, the packers 34 and 36 are radially expanded, or set; but the stage 30 has not been yet fully completed. In this manner, when the stage 30 is fully completed, a gravel pack substrate annularly extends between the tubing string 20 and the wellbore wall. This gravel pack substrate stabilizes the wellbore 15 in the stage 30 and generally prevents produced sand from entering the tubing string 20 while having a limited effect on the production.

For purposes of completing the zone 30 and forming the gravel pack, the tubular string 20 contains an expandable screen assembly 50, which is depicted in FIG. 1 in its run-in-hole, or initial, state. In the state, the screen assembly 50 is radially contracted, which aids in running the screen assembly 50 downhole within the confines of the wellbore 15. More specifically, the tubing string 20 is run downhole with the packers 34 and 36 being unset; and when the screen assembly 50 is in the appropriate position for the stage 30, the packers 34 and 36 are set (as depicted in FIG. 1) to secure the tubular string 20 to the wellbore wall and form the boundaries of the stage 30.

The packers 34 and 36 may be one of numerous different types of packers, such as weight set packers, hydraulically-set packers, mechanically-set packers, inflatable packers, swellable packers, and so forth. Regardless of the particular type of packer that is used, when the packers 34 and 36 are set (i.e., radially expanded to form corresponding annular seals), operations may be conducted to radially expand the screen assembly 50.

Instead of performing a gravel packing operation, which involves communicating a gravel-laden slurry into the annular region that surrounds the screen assembly 50 to form the gravel pack substrate, the screen assembly 50 contains a gravel pack layer 54, which radially expands with the screen assembly 50. More specifically, referring to FIGS. 2 and 3 in conjunction with FIG. 1, the screen assembly 50, in accordance with some embodiments, includes an inner tubular carrier 60. In general, the tubular carrier 60 is a shape changing tubing that contains radial openings 61 (FIG. 3), which allow the inflow and outflow of fluids, such as hydrocarbon fluids, water, etc.

As non-limiting examples, the tubular carrier 60 may be a tubing formed from a mesh material, a slotted tubing, a perforated tubing, a tubing formed from a wire wrapping, etc., as can be appreciated by the skilled artisan. In some embodiments, the material that forms the tubular carrier 60 may have a memory in that the carrier 60, after being expanded, remains in a deformed, expanded state without the aid of any other device maintaining the carrier 60 in this state. In further embodiments, the material that forms the tubular carrier 60 may be resilient in nature; and as such, after the tubular carrier 60 is expanded, a latch or other mechanism may hold the tubular carrier in an expanded state. Regardless of the particular material of the tubular carrier 60, the carrier 60, in general, is coaxial with a longitudinal axis 100 (see FIG. 3), which is generally aligned with the longitudinal axis of the string 20. The tubular carrier 60, in general, is capable of changing its outer diameter, inner diameter, length and/or longitudinal shape.

After being placed in the appropriate position in the stage 30, changes in the shape of the tubular carrier 60 may be effected in one of numerous different ways, as can be appreciated by the skilled artisan. For example, in some embodiments, an expander may be run downhole inside the tubing string 20 and inside the tubular carrier 60 to deform the carrier 60 to radially expand the carrier 60. In other embodiments, differential pressure between a central passageway 24 of the tubing string 20 and the annular region outside of the tubing string 20 may be used to deform the carrier 60 to cause its radial expansion. As another example, the tubing string 20 may contain a sleeve that operates under pressure to longitudinally compress the tubular carrier 60 to radially expand the carrier 60, and a latch of the string 20 may secure the tubular carrier 60 in this radially expanded state.

The gravel pack layer 54 surrounds the tubular carrier 60 and radially expands when the tubular carrier 60 is expanded. The gravel pack layer 54, as noted above, is run downhole into the wellbore 15 as a unit with the tubular carrier 60 as part of the screen assembly 50. The gravel pack layer 54 contains "gravel," that, in accordance with some embodiments, is formed from particles, such as coarse sand or rock particles, which are traditionally used in gravel packing operations and are of the appropriate size to stabilize the wellbore 15 and generally prevent produced sand from entering the tubing string 20. Depending on the particular embodiment, the gravel of the gravel pack layer 54 may be relatively "loose," prior to the expansion of the screen assembly 50. In some embodiments, the gravel may be a mixture of coarse sand or rock particles, along with a relatively weak resin to impart a temporary stiffness to the gravel prior to the expansion of the screen assembly 50.

Figure 2:
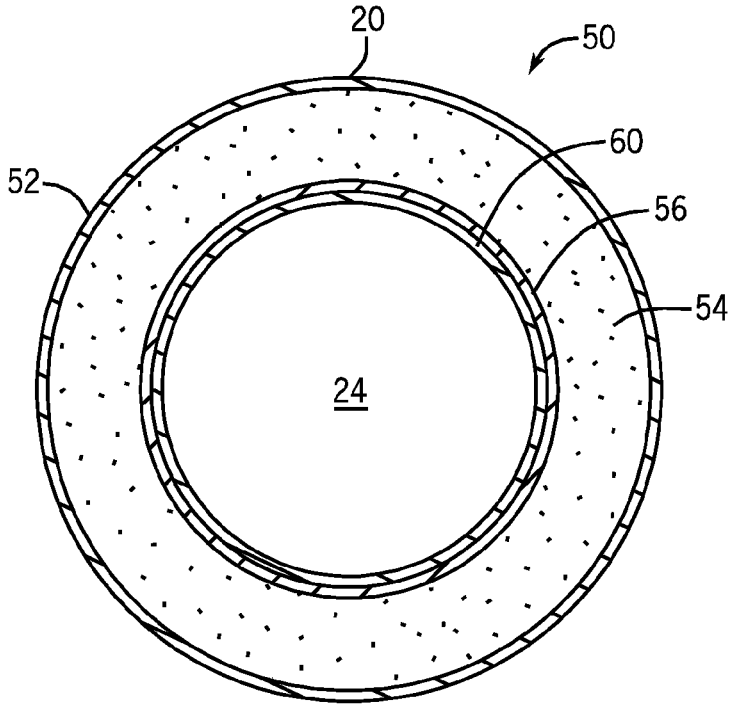
FIG. 2 is a cross-sectional view of an expandable screen assembly taken along line 2-2 of FIG. 1 according to some embodiments.
Figure 3:
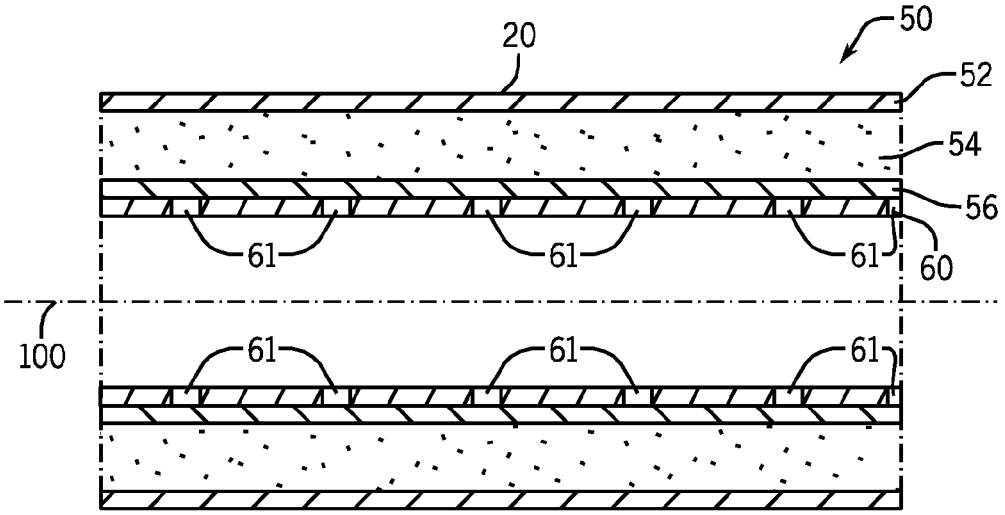
FIG. 3 is a cross-sectional view of the expandable screen assembly taken along line 3-3 of FIG. 1 according to some embodiments.

As depicted in FIGS. 2 and 3, in accordance with some embodiments, the screen assembly 50 has a container that carries the gravel (i.e., the gravel pack layer 54) downhole with the assembly 50. This container may be formed by an inner base containing layer 56 and an outer surface containing layer 52, in accordance with some embodiments. As a non-limiting example, these layers 56 and 52 may be retained in place by rings or other retaining devices (not shown) that are disclosed at the ends of the screen assembly 50.

The base containing layer 56 is interposed between the outer surface of the tubular carrier 60 and the gravel pack layer 54. In some embodiments, the base containing layer 56 is formed from a non-dissolvable and porous/permeable material, such as a plastic, an elastomer, a resin-based material, etc. Due to its porosity/permeability, the based containing layer 56 allows fluid communication between the gravel pack layer 54 and the central passageway 24 of the tubing string 20, while preventing the gravel or produced sand from entering the central passageway 24. In this manner, the base containing layer 56, in accordance with some embodiments, relaxes the relative sizing requirements of the gravel (of the gravel pack layer 54) and the openings 61.

In further embodiments, the base containing layer 56 may be formed from a dissolvable material that is removed with a dissolving agent (pumped in the well 10 from the Earth surface of the well 10, for example) after the screen assembly 50 is in the appropriate position in the stage 30, as further described below. For those embodiments, the screen assembly 50 may contain one or more filtering media layers that are disposed between the tubular carrier 60 and the base containing layer 56.

The surface containing layer 52 surrounds the gravel pack layer 54. Depending on the particular embodiment, the surface containing layer 52 may be an impermeable/non-porous material or a porous material with its pore throat sealed off for purposes of containing the gravel of the gravel pack layer 54 while the screen assembly 50 is run downhole into position. In this manner, after the screen assembly 50 has been appropriately positioned within the stage 30, mechanical and/or chemical activation/actuation may be used for purposes of changing the permeability/porosity of the surface containing layer 52, as further described below.

As non-limiting examples, the surface containing layer 52 may be constructed of a material that is capable of dissolving, such as a plastic, an elastomer, a resin-based material, etc., in the presence of the appropriate dissolving fluid/chemical. In further embodiments, the material of the surface containing layer 52 may be dissolvable in the presence of hydrocarbon-based fluids, which are naturally present in the well 10. In this manner, the hydrocarbon fluids that are naturally present in the downhole environment may be used to dissolve the surface containing layer 52, without the need for the introduction of a particular agent into the well. Moreover, an agent or hydrocarbon fluid, depending on the particular composition of the surface containing layer 52, may be used to dissolve the remaining "parts" of the surface containing layer 52 if mechanical action is used to initially break apart the layer 52, as further discussed below. In some embodiments, the surface containing layer 52 may be formed from a material similar to filter cake, and for these embodiments, the surface containing layer 52 may be dissolved using filter-cake removal fluid/treatment, such as a MudSOLV® filter-cake removal solution that is available from Schlumberger.

In accordance with some embodiments, the surface containing layer 52 and/or the base containing layer 56 may be constructed from one or more the following materials. It is noted that the surface containing layer 52 and the base containing layer 56 may be made from the same material or be made from different materials, depending on the particular embodiment. Moreover, the layer 52 and/or 56 may be constructed from a composite of more than one material. For embodiments in which the layer 52 and/or 56 dissolves in the presence of a hydrocarbon-based fluid, the layer 52 and/or 56 may be constructed from such materials as ethylene propylene diene monomer (M-class) rubber, otherwise called, "EPDM rubber;" or xylene butyl cellosolve, as non-limiting examples. For embodiments in which water is used to dissolve the layer 52 and/or 56, the layer 52 and/or 56 may be constructed from poly-lactic acid (a solid), as a non-limiting example. As another non-limiting example, in some embodiments, the layer 52 and/or 56 may be constructed from a nylon-type of material (any particular grade of nylon, depending on the embodiment), which may be dissolved, as non-limiting examples, with an acid (a hot mineral acid, for example) or an appropriate water-based solvent. For embodiments in which the layer 52 and/or 56 is constructed from EPDM rubber, the EPDM rubber may be dissolved by an appropriate solvent that is pumped into the well 10. In general, the surface containing layer 52 and the base containing layer 56 may be formed a variety of different materials and may be dissolved using a wide range of appropriate solvents/fluids, which may be communicated into the well 10 or may be present naturally in the well, including materials and solvents/fluids that are not listed above. Thus, many variations are contemplated, which are within the scope of the appended claims.

Figure 4:
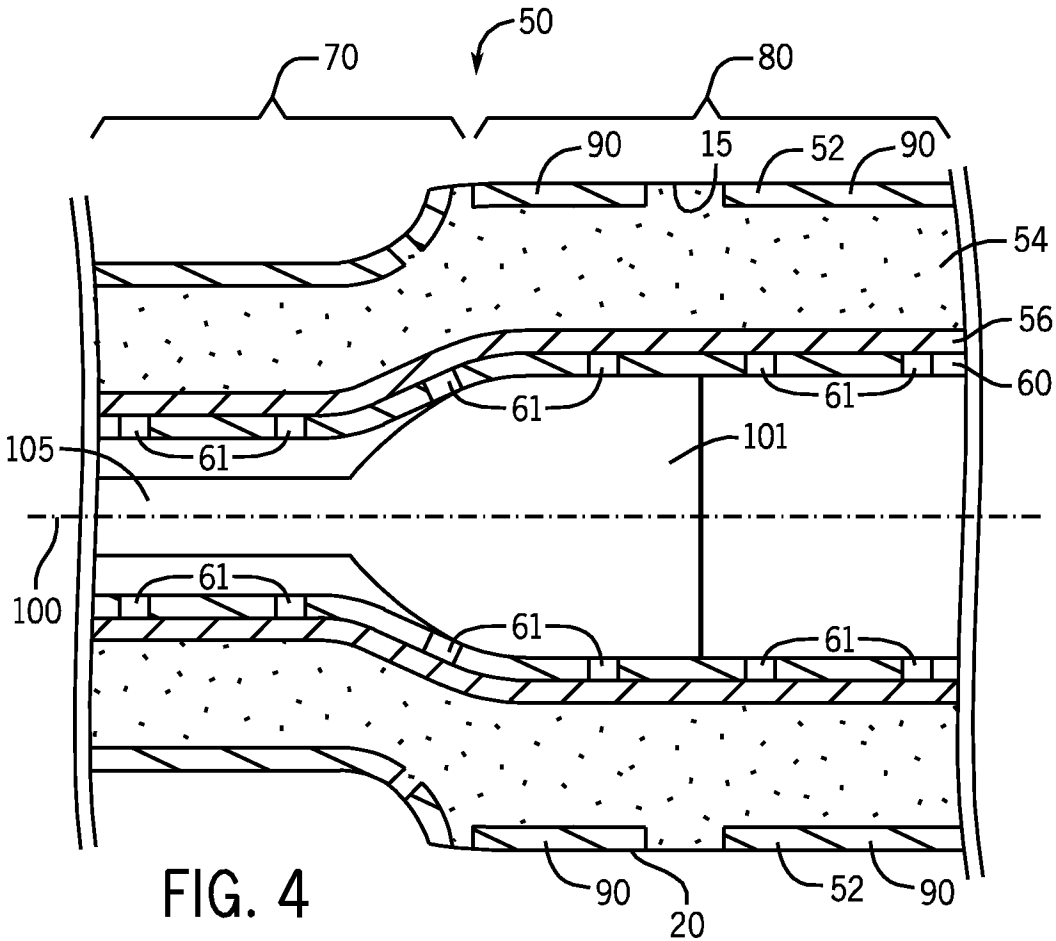
FIG. 4 is a cross-sectional view of the expandable screen assembly illustrating radial expansion of the screen assembly according to some embodiments.

Referring to FIG. 4, as a non-limiting example, the screen assembly 50 may be radially expanded using an expander tool 101. For example, the expander tool 101 may be run downhole (on a tubing string 105, for example) inside the central passageway 24 of the tubing string 20 below the screen assembly 50 and then radially expanded to the outer diameter that is depicted in FIG. 4. With this expanded diameter, the expander tool 101 may then be pulled uphole to draw the tool 101 through the tubular carrier 60 for purposes of radially expanding the carrier 60 (and screen assembly 50). In further embodiments, the screen assembly 50 may be radially expanded by (as non-limiting examples) pushing an expander tool downhole through the assembly 50, using differential pressure to force the expansion of the assembly 50, longitudinally compressing the assembly 50 to cause its radial expansion, and so forth, as can be appreciated by the skilled artisan.

For the example that is depicted in FIG. 4, the expander tool 101 has been pulled part of the way through the screen assembly 50, forming an expanded portion 80 and an unexpanded portion 70 of the screen assembly 50. Moreover, for this example, the outer surface containing layer 52 is mechanically broken apart, thereby forming remaining portions 90, which conform to the wall of the wellbore 15 and allow the gravel to contact various regions of the wellbore wall not containing the portions 90.

Figure 5:
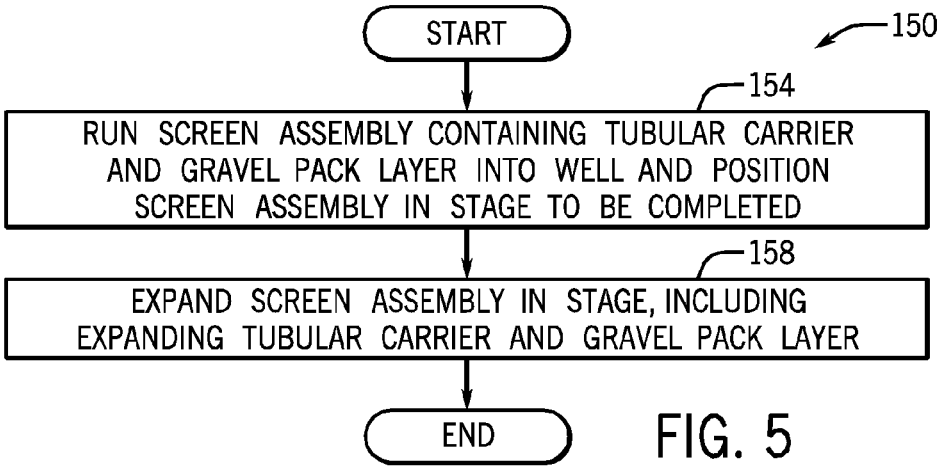
FIG. 5 is a flow diagram depicting a technique to complete an open hole stage of a well using the expandable screen assembly according to some embodiments.

Referring to FIG. 5, thus, in general, a technique 150 to complete a stage of an open hole wellbore includes running (block 154) a screen assembly that contains a tubular carrier and a gravel pack layer into a well and positioning the screen assembly in a stage of the well to be completed. The technique 150 includes expanding the screen assembly in the stage, an expansion that includes expanding the tubular carrier and expanding the gravel pack layer, pursuant to block 158.

Figure 6:
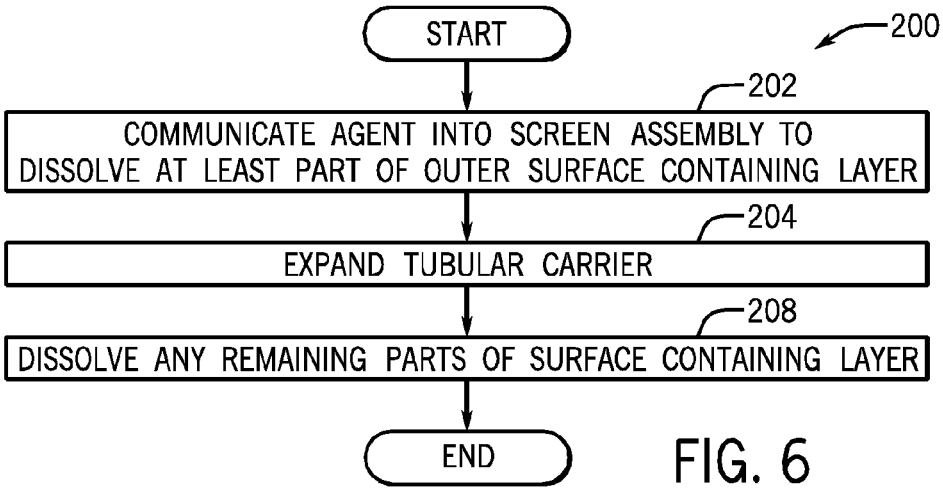
FIGS. 6 and 7 are flow diagrams depicting techniques to radially expand a screen assembly according to some embodiments.

There are many different ways to release the gravel pack layer 54 and in general, expand the screen assembly 50. For example, referring to FIG. 6, for a non-limiting example, a technique 200 includes communicating (block 202) an agent into the screen assembly 50 to dissolve at least part of the outer surface containing layer 52 before the expansion of the tubular carrier 60. For example, the agent may be pumped downhole from the Earth surface. The same agent or another agent may be communicated into the stage for purposes of dissolving the base containing layer 56, depending on the particular embodiment. The shape of the tubular carrier 60 is then altered by radially expanding the tubular carrier (block 204), which results in the gravel of the gravel pack layer 54 being pushed against the wellbore wall. Any remaining parts of the surface containing layer 52 may then be dissolved, pursuant to block 208. In this regard, a particular chemical agent, such as acid or a mud cake removal agent, may be communicated into the well (pumped downhole from the Earth surface, for example) for this purpose. As another non-limiting example, the surface containing layer 52 may dissolve due to the presence of hydrocarbon-based fluids.

Figure 7:
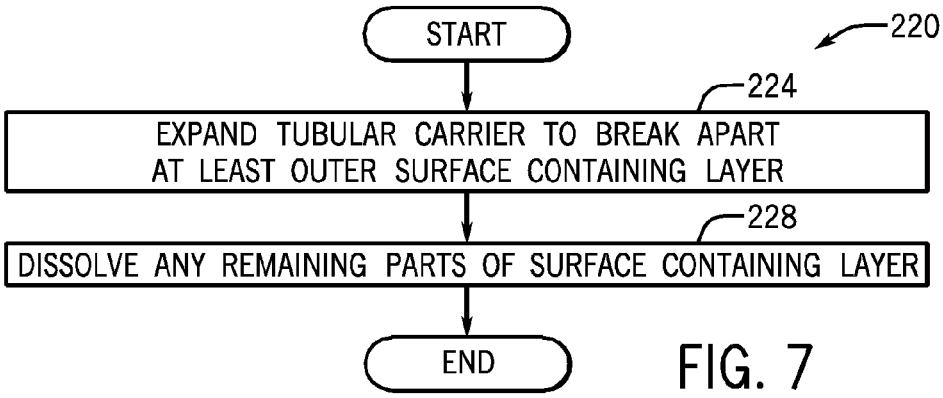

As another example, a technique 220 that is depicted in connection with FIG. 7 may be used for purposes of expanding the screen assembly 50. Pursuant to the technique 220, the tubular carrier 60 is first expanded (block 224) to break apart at least the surface containing layer 52. In this regard, the expansion of the tubular carrier 60 simultaneously expands the gravel pack layer 54 and breaks apart the surface containing layer 52. The gravel of the gravel pack layer 54 is pushed against the wellbore wall together with the residuals of the outer surface containing layer 52. After the carrier tube 60 assumes its final shape, an agent may then be communicated into the stage 30 to dissolve these residual pieces of the surface containing layer 52, pursuant to block 224. Otherwise, in further embodiments, the surface containing layer residuals may be dissolved due to the presence of the hydrocarbon-based fluids.

The screen assembly 50 may, in accordance with further embodiments, have features, which facilitate the removal of the screen assembly 50 during a workover operation. In this manner, for these embodiments, the outer surface containing layer 52 is constructed from a porous/permeable material that remains intact after the radial expansion of the screen assembly 50. The screen assembly 50 may be radially contracted using such techniques as releasing a latch that holds the tubular carrier 60 in its radially-expanded state, using differential pressurization to force the tubular carrier 60 back into its radially contracted state, and so forth. In further embodiments, the outer surface containing layer 52 may be broken up in connection with radially expanding the screen assembly 50, as discussed above; and the tubular carrier 60 may be radially contracted for purposes of performing the workover operation. Thus, many variations are contemplated and are within the scope of the appended claims.

While a limited number of examples have been disclosed herein, those skilled in the art, having the benefit of this disclosure, will appreciate numerous modifications and variations therefrom. It is intended that the appended claims cover all such modifications and variations.

What is claimed is:

1. A method comprising:

running a screen assembly into a well, the screen assembly comprising a tubular carrier and a gravel pack layer such that the tubular carrier and the gravel pack layer are run downhole as a unit, the gravel pack layer comprising gravel;

expanding the screen assembly in a stage of the well, the expanding comprising radially expanding the tubular carrier and the gravel pack layer; and radially contracting the screen assembly from a radially expanded state.

2. The method of claim 1, wherein the act of running the screen assembly comprises covering the gravel pack layer with a layer to retain the gravel pack layer while the screen assembly is being run into the well.

3. The method of claim 2, wherein the layer covering the gravel pack layer comprises a non-permeable layer.

4. The method of claim 1, wherein the act of running comprises disposing an inner layer between the tubular carrier and the gravel pack layer, the inner layer being run downhole with the tubular carrier and gravel pack layer as a unit.

5. The method of claim 4, wherein the inner layer comprises a non-permeable layer.

6. The method of claim 4, wherein the inner layer comprises a permeable layer, the method further comprising running the gravel pack assembly downhole with a filtering layer being disposed between the inner layer and the tubular carrier.

7. The method of claim 1, wherein the act of expanding comprises breaking apart a cover retaining the gravel pack layer.

8. The method of claim 1, further comprising dissolving a cover retaining the gravel pack layer prior to the act of expanding.

9. An apparatus usable with a well, comprising:

a string; and a screen assembly adapted to be run downhole on the string, the screen assembly comprising a tubular carrier and a container, and the container comprising a gravel pack layer comprising gravel, wherein the tubular carrier and the gravel pack layer are adapted to be radially expanded downhole;

the tubular carrier, container and the gravel pack layer are adapted to be run downhole as a unit; and the screen assembly is adapted to transition from a radially expanded state to a radially contracted state.

10. The apparatus of claim 9, wherein the container comprises an outer covering to surround the gravel pack layer as the screen assembly is being run downhole.

11. The apparatus of claim 10, wherein the outer covering comprises a non-permeable layer.

12. The apparatus of claim 9, wherein the container comprises an inner layer disposed between the tubular carrier and the gravel packing layer to retain the gravel packing layer as the screen assembly is being downhole.

13. The apparatus of claim 12, wherein the inner layer comprises a non-permeable layer.

14. The apparatus of claim 9, wherein the container comprises an outer layer to retain the gravel packing layer as the screen assembly is being run downhole, wherein the outer layer is adapted to break apart in response to the expansion of the screen assembly.

15. The apparatus of claim 9, wherein the container comprises an outer cover to retain the gravel pack layer as the screen assembly is being run downhole and dissolve in the presence of an agent introduced into the well.

16. The apparatus of claim 9, wherein the container comprises an outer cover to retain the gravel pack layer as the screen assembly is being run downhole and dissolve in the presence of an agent introduced into the well in response to a hydrocarbon-based fluid.

17. The apparatus of claim 9, further comprising:

at least one packer disposed on the string to form an annular seal between the string and the wellbore wall.

18. An apparatus usable with a well, comprising:

a string; and a screen assembly adapted to be run downhole on the string, the screen assembly comprising a tubular carrier and a container, and the container comprising a gravel pack layer comprising gravel, wherein the tubular carrier and the gravel pack layer are adapted to be radially expanded downhole and the screen assembly is adapted to transition from a radially expanded state to a radially contracted state.

* * * * *